United States Patent [19]

Luker

[11] Patent Number: 4,572,385

[45] Date of Patent: Feb. 25, 1986

[54] TAMPER INDICATING CHILD RESISTANT THREADED CLOSURE

[75] Inventor: Edward Luker, Evansville, Ind.

[73] Assignee: Sunbeam Plastics Corporation, Evansville, Ind.

[21] Appl. No.: 721,948

[22] Filed: Apr. 11, 1985

[51] Int. Cl.[4] ..... B65D 55/02

[52] U.S. Cl. ..... 215/216; 215/218; 215/253

[58] Field of Search ..... 215/217, 218, 216, 225, 215/250, 253

[56] References Cited

U.S. PATENT DOCUMENTS 3,989,152 11/1976 Julian ..... 215/216

4,393,978 7/1983 Kessler et al. ..... 215/253

*Primary Examiner*—George T. Hall

*Attorney, Agent, or Firm*—Fisher, Crampton, Groh and McGuire

[57] ABSTRACT

A tamper indicating, child resistant closure is provided by a one piece threaded cap having a non-backoff feature. The child resistant component is provided by a squeeze and twist lock having a deflectable tab which cooperates with a radially extending container abutment spaced from the container neck. A radially extending tamper indicating block attached to the cap skirt by a frangible web also aligns with the container abutment and prevents opening unthreading until the block is removed. The non-backoff feature is provided by an inwardly directed flange at the bottom of the cap skirt cooperating with a container bead.

13 Claims, 6 Drawing Figures

TAMPER INDICATING CHILD RESISTANT THREADED CLOSURE

This invention is related to a child resistant closure, and more particularly to a threaded child resistant closure having means to indicate tampering or initial opening of the container-closure package.

Many child resistant closures have been developed, some of which require the cooperation of two separately molded pieces and some of which are single unitary caps, threaded to mate with threads on the container and having cooperating elements on the closure and container to render the closure child resistant.

In more recent years, special attention has been given to the development of closures having tamper indicating means to indicate tampering or initial opening of the container. Most of these structures function by fracture or tearing of a frangible or separable element and the problem which must be solved is how to initially apply the closure to the filled container without damage to the tamper indicator.

It is an object of this invention to combine a proven child resistant design with a tamper indicator in a closure in the form of a single piece threaded cap which can be initially applied to the container with conventional capping equipment without the danger of affecting the integrity of the tamper indicator.

It is another object of this invention to provide such a threaded child resistant, tamper indicating closure with means in addition to the screw thread engagement to hold the closure in sealing engagement with the container, resisting any tendency of the closure to loosen or turn in an opening direction. Such a resistance is known as a non-backoff feature.

The foregoing objects are accomplished in a single piece closure having a squeeze and turn child resistant feature, a tamper indicating block integrally molded with a frangible connection and a non-backoff snap retention flange. This closure is designed for use on a container having a tubular neck with external threads, an annular bead below the threads and a lock abutment which is spaced outwardly from the neck. The lock abutment has a stop surface lying in a substantially radial plane of the neck for cooperation with the closure in the unthreading removal of the closure from the container.

The closure is molded as a one piece cap having a flat top and annular skirt depending from the top. The skirt is internally threaded for engagement with complementary threads on the container neck. An inwardly projecting flange is formed at the lower end of the skirt for engagement with the container bead so that the flange passes over the bead and snaps thereunder forming a non-backoff connection as the cap is screwed onto the container. This flange is conveniently formed as a segmented flange with these segments being a plurality of wedge-shaped lugs extending around a substantial portion of the lower end of the skirt. The lugs normally have a radially thicker portion at the lower end, although a symmetrically shaped lug can also be used.

The child resistant feature takes the form of an inwardly deflectable tab mounted at the lower end of the outer skirt surface and having a portion which normally extends radially outward for engagement with the container stop surface when the cap is being unthreaded from the container. The tab is circumferentially positioned on the skirt so that it passes over the container lock abutment during the initial threading closure of the container before the cap flange snaps over the container bead pulling the cap axially downward relative to the container. After the tab has passed the container lock abutment and the flange has snapped over the bottle bead, the radially extending portion of the deflectable tab will be in line with the stop surface of the container to prevent unthreading unless the tab is manually deflected inward as the cap is twisted in an unthreading direction.

The tamper indicating block extends radially outward from the lower end of the outside skirt surface and is also positioned to pass over the lock abutment during the initial threading closure of the container before the cap flange snaps over the container bead. Preferably, the block precedes or is circumferentially spaced downstream from the tab in the closing direction of the cap. In the sealed position, with the cap flange engaged under the container bead, the deflectable tab will have to be squeezed to pass the tab past the bottle abutment before the cap lock contacts the abutment stop surface to prevent further unthreading rotation. The block is joined to the lower end of the cap skirt by a narrow frangible web extending around the vertical sides and top of the block so that the block may be removed by fracturing this frangible connection. The block has a projection which can be gripped to exert a fracturing force to the webs to remove the block or the frangible connection may be broken by exerting an unscrewing torque to the cap sufficient for the coaction of the block with the bottle stop surface to cause such a fracture. Once the block has been removed, the cap can be unscrewed without further obtstruction. The cap flange will snap upward over the container bead at a position where the removed block portion of the skirt has passed the container lock abutment. The absence of the block and the gaping aperture left by its removal will clearly indicate tampering or initial opening of the container.

After the removal of the tamper indicating block, the deflectable tab will continue to function as a child resistant feature upon the reuse of the cap by the engagement of the tab with the container stop surface unless the tab is deflected inwardly during the unthreading process. Also, the non-backoff feature continues to function snapping the cap flange over the container bead when the tab has passed the container lock in the closing direction, and the flange snapping upwardly over the container bead when the tab has passed the container lock abutment in the unthreading direction.

The preferred embodiment of the invention is illustrated in the drawing in which.

Figure 1:
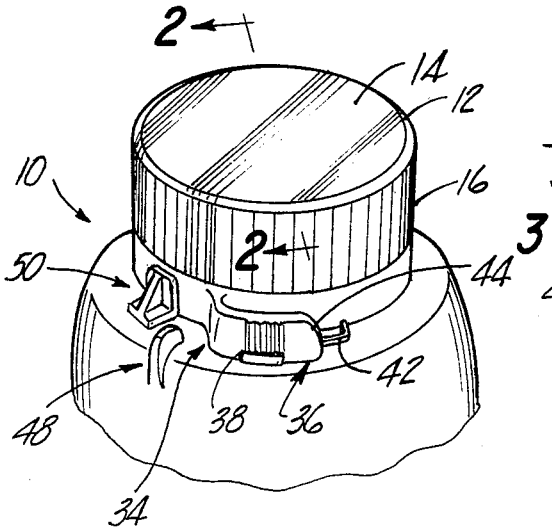
FIG. 1 is a perspective view of the closure assembled to the container with the container lock abutment positioned between the tamper indicating block and the deflectable tab as it would be in the unthreading direction.
Figure 2:
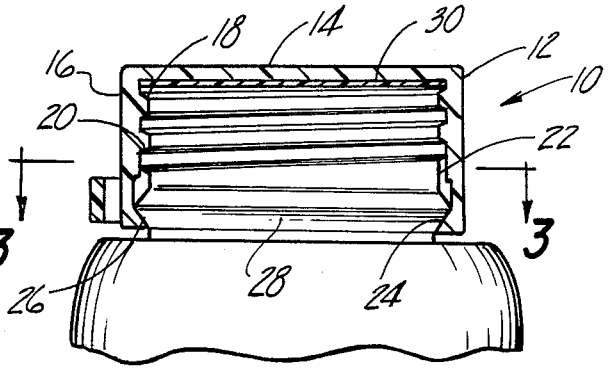
FIG. 2 is a sectional elevation view taken along line 2—2 of FIG. 1.

Referring to the drawing the closure 10 includes a one piece cap 12 having a flat top 14 and an annular skirt 16 extending downwardly from the top 14 having internal threads 18 which will engage complementary threads 20 on the container neck 22. Also on the inside of the skirt at the lower end is an inwardly directed flange 24 adapted to coact with container bead 26 extending outwardly to pass over the apex 28 of bead 26 and snap thereunder to retain the cap on the container. When flange 24 snaps over bead 26 it pulls the cap downwardly assuring a tight seal at liner 30 between the bottle neck 22 and the inside of the cap top 14. This forms a non-backoff seal which resists accidental unthreading and also maintains a tight seal during the initial unthreading of cap 12 from container neck 22. Cap flange 24 may be segmented or formed as a plurality of wedge shaped lugs 32 having their radial thicker portion at their lower ends as shown in FIG. 6.

Figure 3:
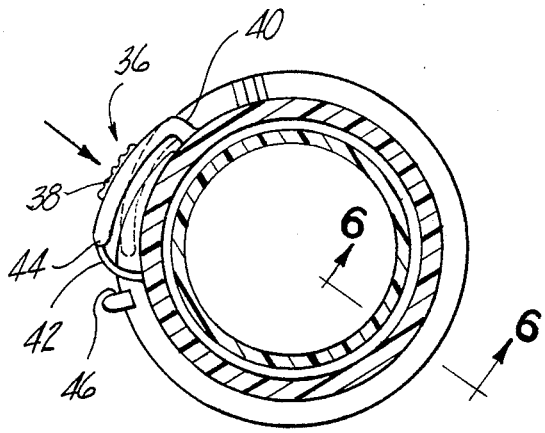
FIG. 3 is a cross sectional view taken along line 3—3 of FIG. 2 but showing the deflectable tab in engagement with the stop surface of the container lock abutment as the cap is being unthreaded.
Figure 4:
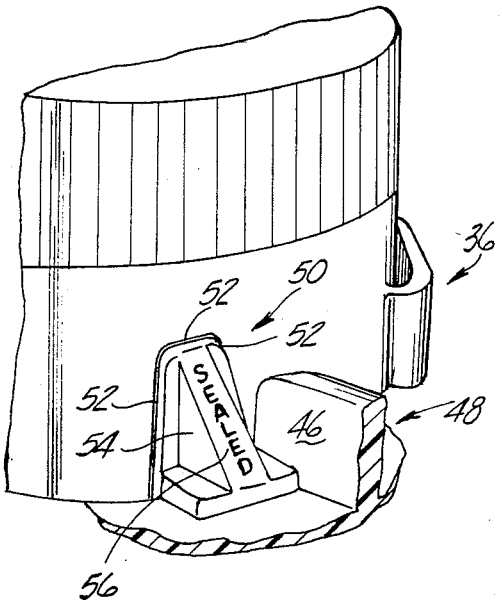
FIG. 4 is a fragmentary perspective showing the tamper indicating block in contact with the stop surface of the container lock abutment as the cap is being unthreaded.
Figure 5:
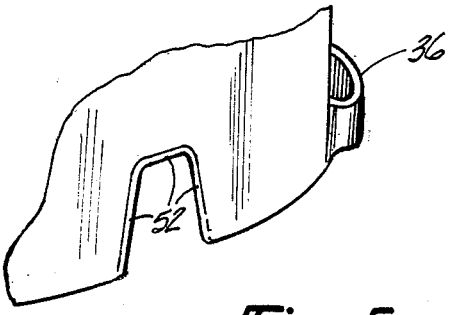
FIG. 5 is a fragmentary sectional view similar to FIG. 4 showing only the cap after removal of the tamper indicating block.
Figure 6:
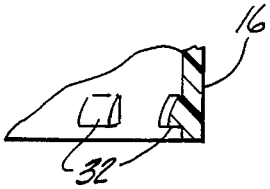
FIG. 6 is a fragmentary view taken along line 6—6 of FIG. 3 showing the cap flange in a segmented form utilizing a plurality of wedge-shaped lugs.

The child resistant locking means 34 is of the type shown in FIGS. 4–6 of U.S. Pat. No. 3,989,152 to Julian and includes a deflectable tab 36 having a radially spaced web 38 connected to the lower cap skirt 16 by a relatively stiff rib 40 along its leading edge and a more flexible bridge 42 at its trailing edge in the closing or threading direction of cap 12. The trailing edge of web 38 has a generally vertically radially extending surface 44 for cooperation with stop surface 46 of container lock abutment 48. As cap 12 is threaded onto container neck 22, deflectable tab 36 passes over the lock abutment 48. When tab 36 is past the abutment 48, cap flange 24 will pass over and snap under container bead 26, moving the cap 12 axially downward relative to the container. This will bring surface 44 of tab 36 in line with stop surface 46 of lock abutment 48 to prevent unthreading of cap 12 until web 38 of tab 36 is manually squeezed inward as shown by the arrow in FIG. 3 in order to move surface 44 inwardly of stop surface 46 to the dotted position shown in FIG. 3 allowing tab 36 to pass abutment 48 as the cap is rotated in the unthreading direction.

It should be understood that while in the preferred embodiment the deflectable tab 36 passes over the lock abutment 48 in the threading, closing rotational direction, it could pass the inner side of abutment 48 by manual depression of web 38 or by providing a cam surface on the abutment if the cap flange is caused to snap over the container flange prior to tab 36 reaching abutment 48.

The tamper indicating block 50 extends radially outward from the lower edge of the outside skirt surface 16 and is positioned to pass over lock abutment 48 during the initial threading closure of the container cap before the flange 24 snaps over the container bead 26. Preferably, the block 50 precedes or is circumferentially spaced downstream from the tab 36 in the closing direction of the cap to assure its passage over the abutment 48 before the cap snaps downward by the coaction of the cap flange 24 and the container bead 26.

When the cap snaps down on the container, the block will be in line with the radial stop surface 46 on abutment 48, and it must be removed to completely unthread cap 12 to open the container. The block 50 is joined to the lower end of the cap skirt 16 by a frangible web 52 extending around the vertical sides and top of the block so that the block may be removed by fracturing web 52. The block has a projection 54 which can be gripped by the fingers of the user to exert a fracturing force and twist the block off the skirt as shown in FIG. 5. Alternatively, the cap can be twisted in an unthreading direction with enough force to cause a fracture as the block abuts against the stop surface 46. Once the block has been removed, the cap can be unscrewed without further obstruction and the cap flange 24 will snap upward over the container bead at a position where the removed block portion of the skirt has passed the container abutment.

As shown in FIG. 4 the projection 54 may have a legend 56 such as "SEALED" to indicate to a perspective purchaser that the package has not been tampered. The absence of the block and the hole left in the cap skirt will clearly indicate tampering or initial opening of the container. The block 50 is circumferentially spaced from the deflectable tab 36 so that the presence or absence of the block is clearly visible to the observer.

In use, the container is filled with product and the cap is threaded onto the container by conventional capping machinery. The tamper indicating block 50 passes over the container abutment 48 first followed by the passage of the deflectable tab 36 over abutment 48. Cap flange 24 then snaps over container bead 26 to provide radial alignment of the block and the deflectable tab with the container abutment 48 while providing a non-backoff feature. The cap will continue to be rotated in the closing direction until the container neck is fully abutted against the top of the cap with the sealing member 30 interposed between the two. In opening the container, the deflectable tab 36 would be squeezed inwardly as the cap is unscrewed to pass the tab past lock abutment 48. The block 50 would then be removed by manually twisting it at projection 54 or by forcing the block 50 against abutment 48 in the unthreading direction. The block 50 is so positioned on skirt 16 to prevent the cap flange from snapping up over the bottle bead until the block position has passed the abutment in the unthreading direction. The child resistant feature provided by the deflectable tab 36 will continue to function after the initial opening of the container.

The embodiments of the invention in which an exclusive property or privilege is claimed are defined as follows:

1. A threaded child resistant, tamper indicating closure for use on a container having a tubular neck with external threads, an annular bead below said threads, and a lock abutment spaced radially outward from said neck with a stop surface lying substantially in a radial plane of said neck, said closure being molded as a one piece cap comprising, in combination: a flat top; an annular skirt depending from said top having internal threads complementary to said container threads; an inwardly projecting flange means at the lower end of said skirt for engagement with said container bead, snapping thereunder as said cap is threaded onto said container; a deflectable tab on said skirt having a portion normally extending radially outward for engagement with said container stop surface when said cap is being unthreaded from said container with said container bead and said flange means in engagement with each other and being movable relative to said stop surface by manual inward deflection thereby permitting said tab to pass said stop surface when said cap is being unthreaded; and a tamper indicating block extending radially outward from said skirt positioned to come into contact with said stop surface to prevent unthreading of said cap until said block is removed from said skirt.

2. The threaded safety closure according to claim 1 wherein said block is positioned on said skirt to pass over said container lock abutment during initial closing of said container before said cap flange snaps over said container bead.

3. The threaded safety closure according to claim 1 wherein said deflectable tab is positioned on said skirt to pass a container lock abutment during initial closing of said container before said cap flange snaps over said container bead.

4. The threaded closure according to claim 1 wherein said block and said deflectable tab are both positioned on said skirt to pass said container lock abutment during initial closing of said container before said cap flange snaps over said container bead.

5. The threaded closure according to claim 4 wherein said block is circumferentially spaced upstream in an unthreading direction from said tab to permit said tab to pass said container stop surface before said block comes into contact with said stop surface to prevent further unthreading of said cap until said block is removed from said skirt.

6. The threaded closure according to claim 2 wherein said block is attached to said cap skirt by a frangible connection whereby said block can be removed by fracturing said frangible connection, indicating tampering and initial opening of said container.

7. The threaded safety closure according to claim 6 wherein said frangible connection is a frangible web along the two axial sides and top of said block joining the block to said skirt.

8. The threaded safety closure according to claim 7 wherein said webs can be fractured and said block removed by engagement of said block with said stop surface when said cap is being rotated in an unthreading direction.

9. The threaded safety closure of claim 7 wherein said block has a projection which can be gripped to exert a fracturing force to said webs to remove said block.

10. The threaded safety closure according to claim 1 wherein said flange means comprises a segmented bead.

11. The threaded safety closure of claim 10 wherein said segments comprise a plurality of wedge-shaped lugs extending around a substantial portion of the lower end of said skirt, said lugs having a radially thicker portion at the lower ends.

12. A child resistant, tamper indicating threaded closure for use on a container having a tubular neck with external threads, an annular bead below said threads, and a lock abutment spaced radially outward from said neck with a stop surface lying substantially in a radial plane of said neck, said closure being molded as a one piece cap comprising, in combination: a flat top; an annular skirt depending from said top having internal threads complementary to said container threads; an inwardly projecting flange means at the lower end of said skirt for engagement with said container bead, snapping thereunder as said cap is threaded onto said container; a tampering indicating block extending radially outward from said skirt for engagement with said stop surface; a deflectable tab on said skirt extending radially outward from said skirt for engagement with said stop surface and being circumferentially spaced upstream from said block in the closing direction of said cap; said block and said tab being positioned on said skirt so that both pass over said lock abutment during the initial threading closing of said container, and said cap flange snaps over said container bead after said tab is passed said lock abutment; and when said cap is initially unthreaded from said container, said cap flange will remain engaged with said container bead so that said tab must be manually deflected inwardly to pass said stop and said block will come into contact with said stop surface to prevent unthreading of said cap until said block is removed from said skirt; and after removal of said tamper indicating block, said deflectable tab will continue to function as a child resistant feature upon reuse of said cap by engagement of said tab with said container stop surface.

13. A threaded closure according to claim 12 wherein said block is attached to said cap by a frangible connection whereby said block can be removed by fracturing said frangible connection, indicating tampering and initial opening of said container.

* * * * *